US008247725B2

(12) United States Patent
Morita et al.

(10) Patent No.: US 8,247,725 B2
(45) Date of Patent: Aug. 21, 2012

(54) VACUUM SWITCHGEAR

(75) Inventors: Ayumu Morita, Hitachi (JP); Takashi Sato, Mito (JP); Tomoaki Utsumi, Hitachi (JP); Makoto Yano, Mito (JP); Kenji Tsuchiya, Hitachi (JP); Masato Kobayashi, Hitachi (JP); Shuichi Kikukawa, Hitachi (JP); Junichi Katagiri, Naka (JP)

(73) Assignee: Hitachi, Ltd., Tokyo (JP)

( * ) Notice: Subject to any disclaimer, the term of this patent is extended or adjusted under 35 U.S.C. 154(b) by 271 days.

(21) Appl. No.: 12/617,109

(22) Filed: Nov. 12, 2009

(65) Prior Publication Data

US 2010/0122967 A1 May 20, 2010

(30) Foreign Application Priority Data

Nov. 14, 2008 (JP) ..... 2008-291631

(51) Int. Cl.
*H01H 33/66* (2006.01)

(52) U.S. Cl. ..... 218/140; 218/120

(58) Field of Classification Search ..... 218/2–14, 218/43–47, 118–120, 140, 152–154
See application file for complete search history.

(56) References Cited

U.S. PATENT DOCUMENTS

| | | | | |
|---|---|---|---|---|
| 5,864,942 | A | 2/1999 | Luzzi | |
| 2007/0145015 | A1 | 6/2007 | Fink et al. | |
| 2007/0175866 | A1 * | 8/2007 | Tsuchiya et al. | 218/10 |
| 2008/0190895 | A1 * | 8/2008 | Sato et al. | 218/120 |

FOREIGN PATENT DOCUMENTS

| | | | |
|---|---|---|---|
| EP | 1 343 233 | | 9/2003 |
| EP | 1 814 131 | | 8/2007 |
| JP | 08222093 A | * | 8/1996 |
| JP | 2003-045300 | | 2/2003 |
| JP | 2007-028699 | | 2/2007 |

OTHER PUBLICATIONS

European Search Report in European Patent Application No. 09014127.6-2214 dated Feb. 26, 2010.

Chinese Office Action mailed May 3, 2012 in corresponding Chinese Patent Application No. 200910208374.1 with partial English language translation.

* cited by examiner

*Primary Examiner* — Amy Cohen Johnson
*Assistant Examiner* — Marina Fishman
(74) *Attorney, Agent, or Firm* — Brundidge & Stanger, P.C.

(57) ABSTRACT

A vacuum switchgear has a vacuum valve including a movable conductor connected to an insulating rod, and a fixed conductor connected to a bus bar or to a load cable, a vacuum chamber encasing the vacuum valve, an insulating envelope covering the vacuum chamber, the outer surface thereof being covered with an electro-conductive layer thereby to earth the envelope, and an insulating lid gas-tightly fitted to the insulating envelope. The lid has an insulating bushing through which an insulating rod penetrates, the insulating rod being connected to an operating mechanism, wherein the insulating rod except a portion exposed from the bushing is gas-tightly confined in insulating gas atmosphere formed between the insulating envelope and the insulating lid.

16 Claims, 10 Drawing Sheets

VACUUM SWITCHGEAR

CLAIM OF PRIORITY

The present application claims priority from Japanese Patent Application Serial No. 2008-291631, filed on Nov. 14, 2008, the content of which is hereby incorporated into this application by reference.

FIELD OF THE INVENTION

The present invention relates to a compact and downsized vacuum switchgear having an improved reliability and protection against contamination.

RELATED ART

Electric power receiving installations are provided with closed type distribution panels (so-called switchgears), which comprise a vacuum circuit breaker for interrupting load current or fault current in accidents, a disconnector and an earth switch for securing safety of a person who inspects or maintains the load, a detector for detecting a system voltage and current, a protection relay, etc.

There are many kinds of insulating methods for the switchgears. In addition to GIS (gas insulated switchgears) using $SF_6$ gas, compressed air, vacuum and solid insulating moldings have appeared in view of environmental consideration. In the solid insulating moldings main circuit components such as vacuum valves, and connecting conductors constituting the main circuits are molded with insulating materials such as epoxy resins to form an insulating envelope, as disclosed in Patent document No. 1.

Patent document: JP2007-28699

However, in the conventional solid insulating molding since movable conductors of the vacuum valves are located in air, which is low in insulating withstanding, a sufficient insulating distance on the insulating rod was necessary, which makes the switchgear large in size. The patent document No. 1 teaches an insulating envelope covering the vacuum valves so as to limit lengths of the switchgear in depth and width directions; but the insulating envelope itself becomes large because the space for accommodating insulating components is in air so that the components may be contaminated to lower its insulating withstanding. That is, in the switchgear shown in the patent document No. 1 the insulating rods connected to the movable conductors are exposed to air, which is not completely isolated from the atmosphere. Therefore, the length of the insulating rods should be sufficiently long so as to secure an insulating distance in view of dirt and contamination.

SUMMARY OF THE INVENTION

The present invention aims at providing a compact and downsized vacuum switchgear with high reliability. The vacuum switchgear according to the present invention has an insulating bushing through which a movable insulating rod penetrates and is connected with an operating mechanism, wherein the insulating rod confined in a gas insulated atmosphere is gas-tightly isolated from the atmosphere.

According to embodiments of the present invention, it is possible to downsize the vacuum switchgear because the insulating rod connected to the movable conductor, which is connected to an operating mechanism, is covered with a solid insulating bushing to thereby protect it from dirt or contamination.

PREFERRED EMBODIMENTS OF THE PRESENT INVENTION

The present invention provides the following embodiments.

More particularly, the present invention provides the following embodiments.

(1) A vacuum switchgear comprising:

at least one vacuum valve comprising a movable conductor having a movable contact, connected to an insulating rod, and a fixed conductor having a fixed contact, connected to a bus-bar or to a load cable, wherein the contacts make electrical contact and separation therebetween;

a vacuum chamber encasing the vacuum valve;

an insulating envelope covering the vacuum chamber, the outer surface thereof being covered with an electro-conductive layer thereby to earth the envelope;

an insulating lid, which is gas-tightly fitted to the insulating envelope, the lid having an insulating bushing through which an insulating rod penetrates, the insulating rod being connected to an operating mechanism, wherein the insulating rod except a portion exposed from the bushing is gas-tightly confined in insulating gas atmosphere formed between the insulating envelope and the insulating lid.

(2) The vacuum switchgear according to the above embodiment, wherein the vacuum valve is a vacuum double break three position stop type, which comprises at least two vacuum valves each being confined in a vacuum chamber, movable conductors of the vacuum valves being connected to the insulating rod via a connecting conductor.

(3) The vacuum switchgear according to the above embodiment, wherein the insulating envelope contains the vacuum valve and an earth switch, wherein the earth switch disposed in the insulating envelope comprises a vacuum chamber for accommodating a movable conductor having a movable contact and a fixed conductor having a fixed contact, the movable conductor being connected to the operating mechanism.

(4) The vacuum switchgear according to the above embodiment, wherein the insulating rod is slidably inserted into the bushing, the insulating gas atmosphere between the insulating envelope and the lid being sealed from the atmosphere.

(5) The vacuum switchgear according to the above embodiment, wherein the insulating envelope and the lid are gas-tightly sealed with an insulating rubber.

(6) The vacuum switchgear according to the above embodiment, wherein the inner surface of the lid is covered with an electrically conductive inner coating to make a potential of the inner coating equal to that of the movable conductor.

(7) The vacuum switchgear according to the above embodiment, wherein at least part of the lid is made of a flexible material that allows the movement of the movable conductor, keeping gas-tight sealing of the insulating gas atmosphere.

(8) A vacuum switchgear comprising:

a vacuum valve comprising at least two movable conductor each having a movable contact, connected to an insulating rod, and at least two fixed conductors each having a fixed contact, connected to a bus bar or to a load cable, wherein the contacts make electrical contact and separation therebetween;

vacuum chambers each encasing each of the vacuum valve, the vacuum valves being isolated;

an insulating envelope covering the vacuum chambers, the outer surface thereof being covered with an electro-conductive layer thereby to earth the envelope;

an insulating lid gas-tightly fitted to the insulating envelope, the lid having insulating bushing through which the insulating rods penetrate, each of the insulating rods being connected to an operating mechanism, wherein each of the insulating rods except portions exposed from the bushing is gas-tightly confined in insulating gas atmosphere formed between the insulating envelope and the insulating lid.

(9) The vacuum switchgear according to claim 9, wherein the insulating envelope and the insulating lid are gas-tightly sealed with an insulating rubber fitted therebetween.

(10) The vacuum switchgear according to the above embodiment, wherein an earth switch comprising a vacuum chamber for accommodating a movable conductor having a movable contact and a fixed conductor having a fixed contact is molded together with the vacuum valves, the movable conductor being connected to the operating mechanism.

(11) The vacuum switchgear according to the above embodiment, wherein the vacuum valve are integrally molded with an insulating resin to form the insulating envelope.

(12) The vacuum switchgear according to the above embodiment, wherein the vacuum valves are integrally molded with an insulating resin to form the envelope.

(13) The vacuum switchgear according to the above embodiment, wherein the insulating envelope has a insulating wall between the vacuum valves.

(14) The vacuum switchgear according to the above embodiment, wherein the insulating envelope has a insulating wall between the vacuum valves.

In the following the preferred embodiments of the present invention will be explained in detail by reference to attached drawings.

Figure 1:
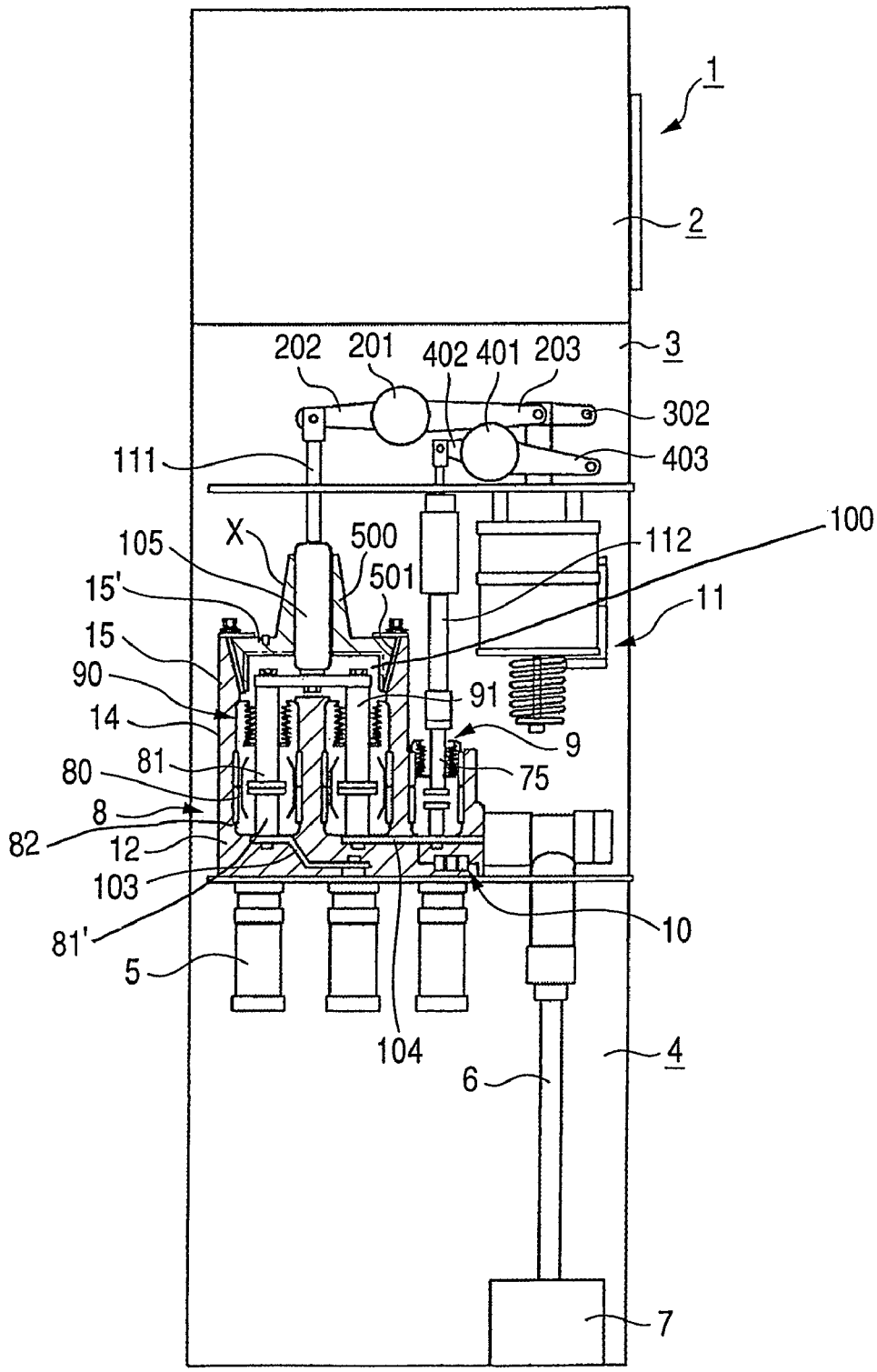
FIG. 1 shows a side sectional view of a vacuum switchgear according to the first embodiment.

Reference numerals used in the drawings are as follows. vacuum switchgear 1; low voltage control section 2; high voltage switching section 3; bus-bar cable section 4; bus-bar 5; cable 6; current transformer (CT) 7; vacuum double break three-position type switch 8: earth switch 9; voltage transformer (VD) 10; operating mechanism 11; epoxy resin 12; shield layer between phases 13; outer surface 14; insulated envelope 15; vacuum valves 60, 80, 90; movable conductors 61, 74, 75, 81, 91, 94; fixed conductors 73' 81', 91'; vacuum chambers 71, 82, 92; fixed contacts 73, 83, 93; movable contacts 74, 82, 84, 94; flexible conductor 96; conductor 100; feeders 103, 104; insulating rod 105; operating rod 111; insulated operating rod 112; supporting plate 113; first operating mechanism 200; first shafts 201, 401; levers 202, 203, 301, 304, 402, 403, 414; electromagnets 205, 305, 405; driving shafts 206, 306, 406; movable iron cores 207, 307, 407; fixed iron core 208, 308, 408; coils 209, 309, 310, 409; permanent magnet 210 410; trip spring receiver 211; trip spring 212; roller 303; crank lever 304; return spring 311; operating mechanism 400; second shaft 401; shaft 413; pins 302, 412; insulating bushing 500; insulating rubber 500', 501; rubber rings 502, 503; wiring 504; portions 505, 506; plate 510; disc spring 511; terminals 600; conductive coatings X, Y; sliding face Z.

Figure 2:
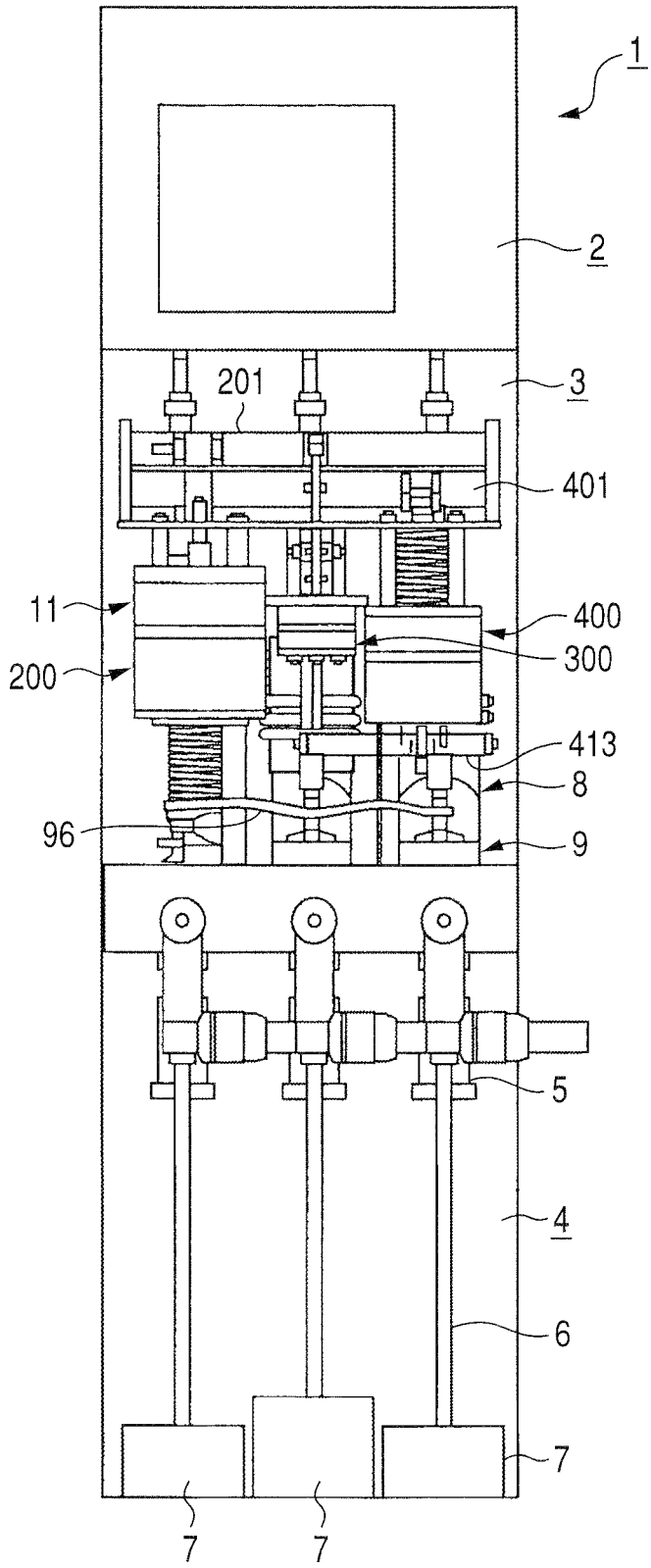
FIG. 2 shows a front view of the switchgear shown in FIG. 1.
Figure 3:
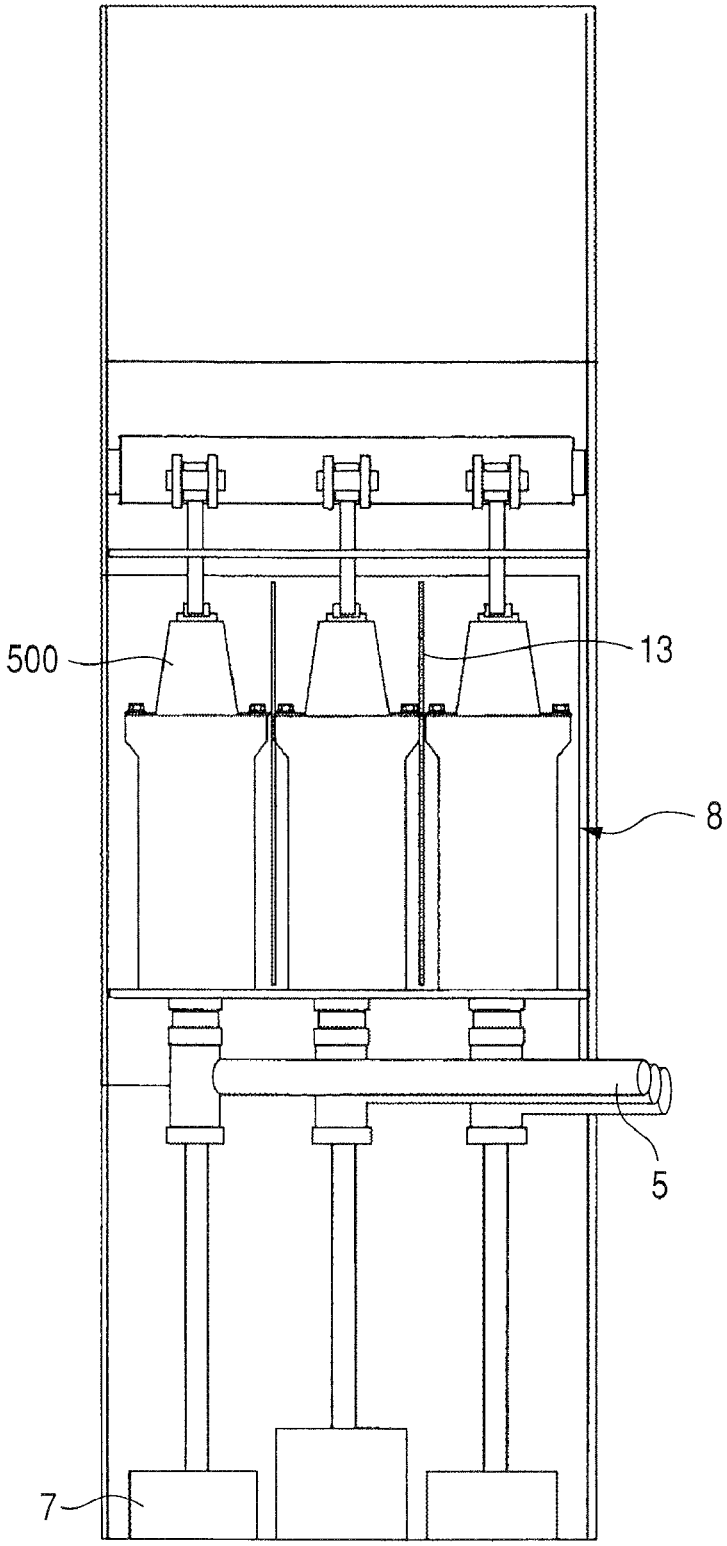
FIG. 3 shows a back view of the vacuum switchgear shown in FIG. 1.

In FIGS. 1-3 the vacuum switchgear 1 comprises a low voltage control section 2, a high voltage switch section 3 and a bus-bar cable section 4, which are arranged from the top to the bottom.

In the bus-bar cable section 4 there are a solid-insulated bus-bar 5, a cable 6 for line side, a bushing current transformer CT 7, etc. In the high voltage switch section 3 there are a vacuum double break three position type switch (vacuum double break three position type circuit breaking disconnector BPS) 8, an earth switch (ES) 9 with a vacuum closing capacity, a voltage detector (VD) 10 and an operating mechanism 11. The bus-bar 5, which is solid-insulated, does not need gas insulation with $SF_6$ so that the safety and operability of the bus-bar are increased.

Figure 4:
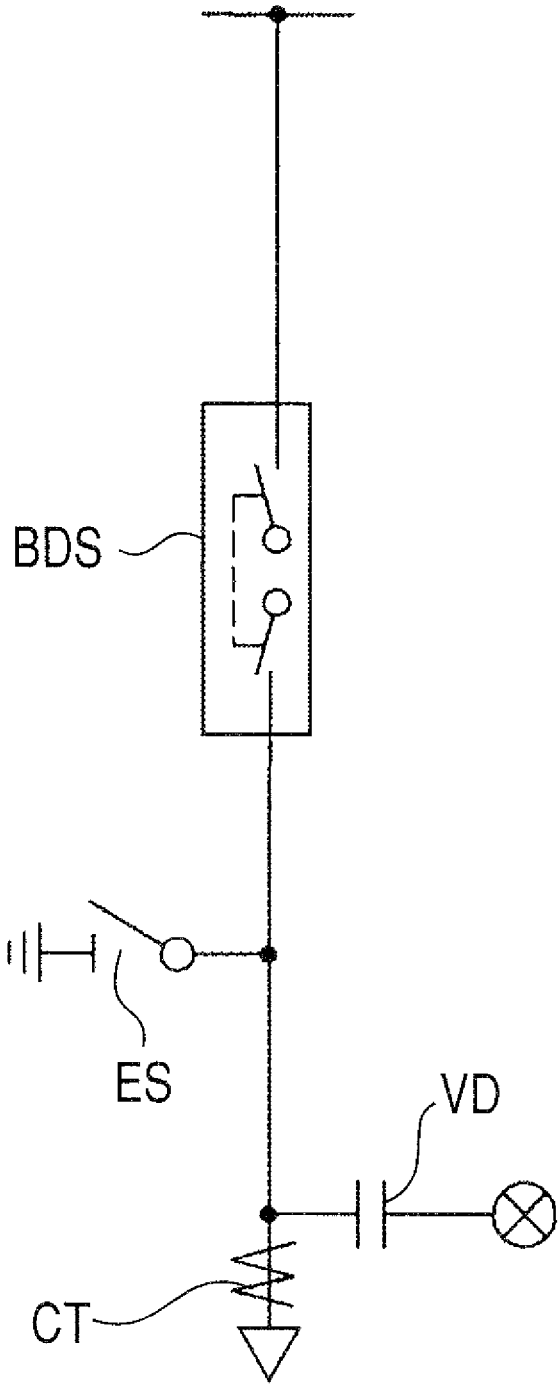
FIG. 4 shows an electrical circuit of the switchgear shown in FIG. 1.

An electric circuit of the vacuum switchgear shown in FIG. 1 is shown in FIG. 4.

The vacuum double break three position switch (BDS) 8, the earth switch (ES) 9 with the vacuum closing capacity and the voltage detector (VP) 10 are integrally molded and solid-insulated with insulating material such as thermosetting epoxy resin 12 to form an insulating envelope 15. The envelope 15 surrounds and insulates the BDS, ES and VD from each other. Walls of the resin separate BDS and ES. The envelope and the elements constitute a switching unit. There are three units in one switchgear for three phases. The units are separated for each phase. Further, there are shields 13 between the units to suppress short circuit faults between the phases.

An outer surface 14 of the envelope 15 is covered with an electro-conductive coating X, which is earthed to thereby secure safety in case of touching the switchgear.

The switch unit will be explained in detail by reference to FIGS. 1 and 5.

The vacuum double break three position type switchgear 8 comprises two vacuum valves 80, 90 and a connecting conductor 100 for connecting movable conductors 81, 91 of the vacuum valves. The vacuum valve 80 comprises a vacuum chamber 82 with an insulating cylinder. The connecting conductor is connected to one end of an insulating rod 105, the other end thereof being connected to the operating mechanism 11. The connecting conductor 100 is stiff and withstands bending by the stress applied thereto at the time of operation of the insulating rod. Therefore, both of the movable conductors move simultaneously upon the movement of the insulating rod, driven by the operating mechanism.

The fixed conductor 81' having the fixed contact 83 of the vacuum valve 80 is connected to the bus-bar 5 via a feeder 103. The fixed conductor 91' having the fixed contact 93 of the vacuum valve 93 is connected to a cable 6 a feeder 104.

The movable conductors 81, 91 are connected to each other by the connecting conductor 100 to which the insulating rod 105 is connected. The insulating rod 105 is connected to an operating rod 111 of an operating mechanism 11.

The movable conductors 74, 94 can stop at the three positions, i.e. a closed position Y1 for supplying current, an open position Y2 for breaking current and a disconnection position Y3 for securing safety of an inspector against a surge voltage such as a thunder.

Figure 5:
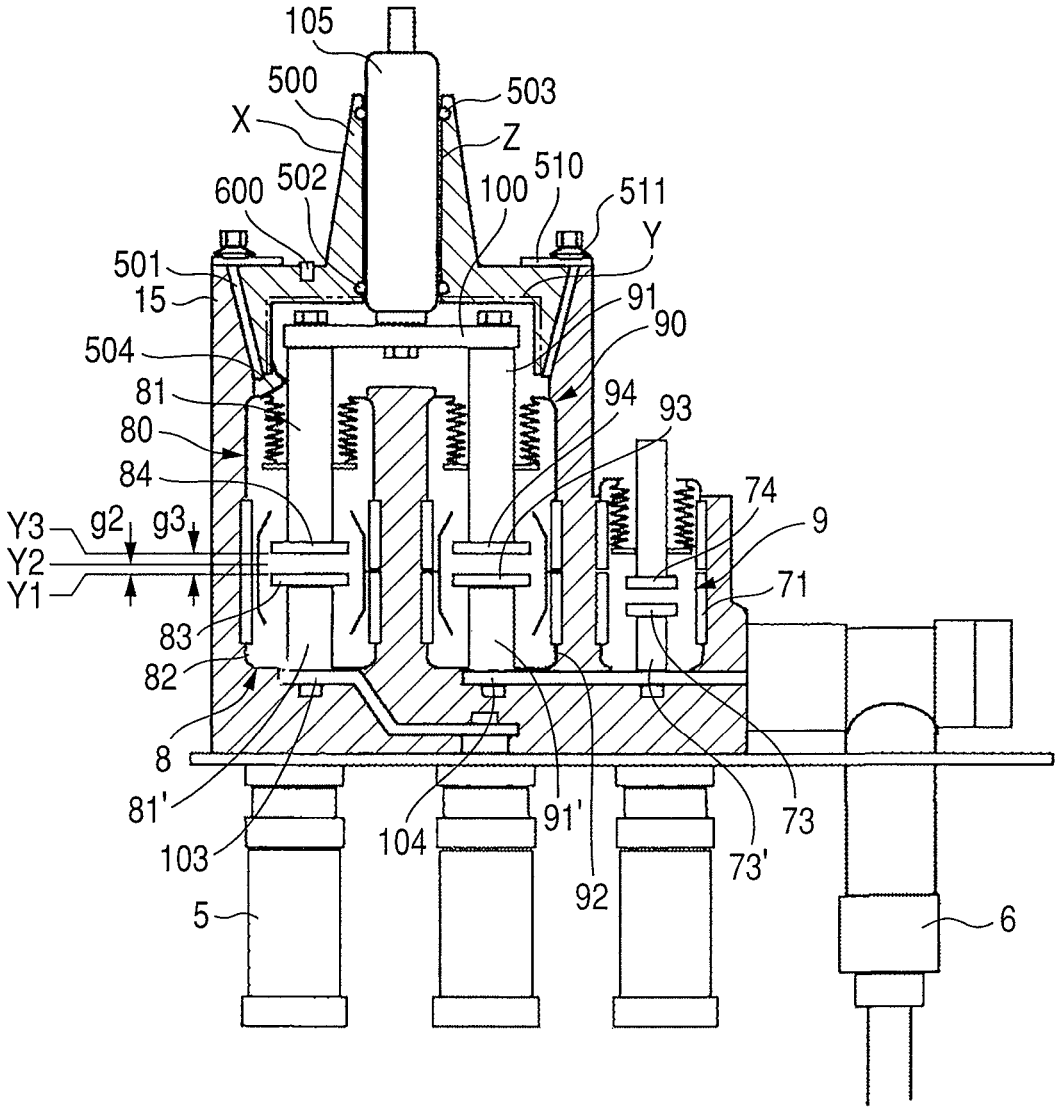
FIG. 5 shows a cross sectional view of a vacuum valve of the vacuum switchgear shown in FIG. 1.

The movable contacts 84, 94 keep a breaking gap g2 at the breaking position Y2 and a disconnection gap g3 at the disconnection position Y3, as shown in FIG. 5. The disconnection gap g3 is set to be approximately two times the distance of g2. As explained above, the reliability of the switch at the disconnection is improved by setting the disconnection gap g3 to be two times the breaking gap g2 whereby the two vacuum valves 80, 90 have the two kinds of gaps.

An earth switch (ES) 9 with a vacuum closing capacity comprises, as shown in FIG. 5, a vacuum chamber 71 provided with an insulating cylinder, a fixed conductor 73' having a fixed contact 73 fixed in the vacuum chamber 71 and connected to a feeder 104, and a movable conductor 75 having a movable contact 74. The movable conductor 75 is connected to an insulating operating rod 112 for the earth switch, as shown in FIG. 1.

The vacuum switchgear 1 of this embodiment has a solid insulation by resin molding for insulating phases and two vacuum insulations for insulating the electrodes so that the insulation relationship of inter-phase insulation>inter-electrode insulation at disconnection>inter-electrode insulation at breaking>inter-electrode insulation of the earth switch is established to secure the insulation conformity required for the switchgear. As a result, the fault is controlled to a one line short circuit at the time of accident to thereby suppress propagation of accident.

Next, operation of the operating mechanism 11 for switching to three positions of the closed position Y1 for supplying current in the switch 8, the breaking position Y2 for breaking current and the disconnection position Y3 for securing safety of the inspector against the surge voltage by thunder, etc and the earth switch 9 will be explained by reference to FIG. 6.

Constituting components of the operating mechanism 11 are fixed to a supporting plate 113 disposed in the high voltage switch section 3. The operating mechanism 11 comprises a first operating mechanism 200, for switching the movable contacts 84, 94 of the switch 8 to the closed position Y1 and the open position Y2, a second operating mechanism 300 for switching the movable contacts 84, 94 to the open position Y2 and the disconnection position Y3 and a third operating mechanism 400 for switching the movable contact 74 of the earth switch 9.

At first, the constitution of the first operating mechanism 200 will be explained by reference to FIGS. 1, 2 and 6. In FIG. 6, which shows a perspective view of the operating mechanism, there are three vacuum switches 8 and three earth switches 9 are arranged, and the movable conductors of the vacuum switches are connected to the insulating rods, connected to the operating mechanism. A first shaft 201 is supported to be able to swing by the supporting plate 113. Three levers 202 are fixed to the first shaft 201, as shown in FIG. 1, along a direction of arrangement of the first shafts 201. The levers 202 are each connected to each of operating rods 111 at their tip portion. One end of each first shaft 201 is fixed to each lever 203 in a direction opposite to the levers 202, as shown in FIGS. 6 and 1.

The movable conductors of the earth switches 9 are electrically connected by a flexible conductor 96.

Figure 6:
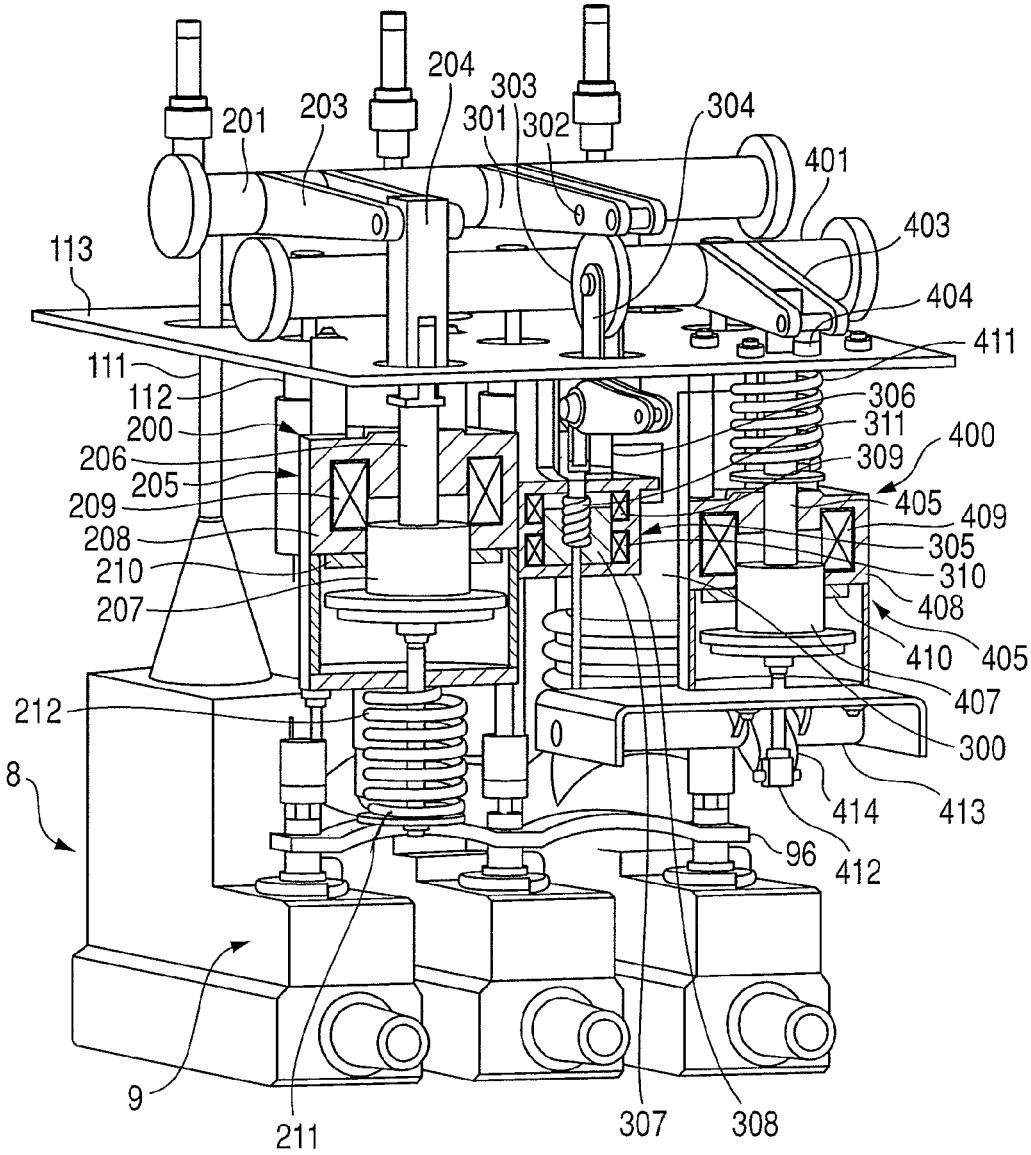
FIG. 6 shows a perspective view of the vacuum valve and an operating mechanism for the vacuum switchgear shown in FIG. 1.

A driving shaft 206 of an electromagnet 205 is connected to the lever 203 via a connecting member 204, as shown in FIG. 6. A movable iron core 207 having a T shape in its cross section is fixed to the driving shaft 206. Fixed iron cores 208 fixed to the supporting plate 113 are arranged around the movable iron core 207. An annular permanent magnet 210 is disposed in the inside of the fixed iron core 208. A trip spring receiver 211 is disposed at the opposite side to the lever 203 at the driving shaft 206. A trip spring 212 is disposed between the trip spring receiver 211 and the fixed iron core 208.

The electromagnet 205 has a retaining force by attractive force of the permanent magnet 210 against a biasing force of a contact spring (not shown) disposed to the insulating rod 105 and the trip spring 212, when the movable contacts 84, 94 are held at the closed position Y1. The above constitutes a magnetic latch system utilizing an attractive force.

Next, constitution of the second operating mechanism 300 for switching the movable contacts 84, 94 of the switch 8 will be explained by reference to FIG. 6. The lever 301 is fixed at a halfway of the first shaft 201 on the supporting plate 113. The lever 301 is provided with a pin 302 at its tip. A roller 303 touches the pin 302. The roller 303 is disposed rotatably at the tip portion of the crank lever 304. The crank lever 304 is supported to be able to swing on the lower surface of the supporting plate 113.

The driving shaft 306 of the electromagnet 305 is connected to the tip portion of the other end of the crank lever 304. The movable iron cores 307 are fixed to the driving shaft 306. The fixed iron cores 308 fixed to the supporting plate 113 are arranged around the movable iron cores 307. Upper and lower coils 309, 310 are disposed inside the fixed iron cores 308. A return spring 311 is disposed between the movable iron core 307 and an upper position of the fixed iron core 308.

The electromagnet 305 excites the coils 309, 310 to drive the movable iron cores 307 in up and down directions. By this movement, the crank lever 304 swings. By the swing movement of the crank lever 304, a touching position between the pin 302 and the roller 303 changes to thereby prevent swing action of the lever 203 around the first shaft 201 or to allow the swing action. As a result, the movable contacts 84, 94 are prohibited to move from the open position Y2 to the disconnection position Y3 to be maintained at the open position Y2 or allows the movement from the open position Y2 to the disconnection position Y3. That is, the above constitution is an interlock mechanism between the open position Y2 and the disconnection position Y3 of the movable contacts 84, 94.

Next, constitution of the third operating mechanism 400 for operating the movable contact 74 of the earth switch 9 will be explained by reference to FIG. 6. The second shaft 401 is supported to be able to swing to the supporting plate 113. Three levers 402 are fixed to the first shaft 401, as shown in FIG. 1, in a direction of arrangement of the first shafts 401. Each of the tip of the levers 402 is connected to each of the connecting rods 112. In addition, levers 403 are connected to one end of the second shaft 402 at the opposite direction of the lever 402.

The driving shaft 406 of the electromagnet 405 is connected to the levers 403 via the connecting member 404, as shown in FIG. 6. The electromagnet 405 has the same constitution as that of the electromagnet 205 of the first operating mechanism 200. The movable iron core 407 having a T-form in its cross section is fixed to the driving shaft 406 of the electromagnet 405. The fixed iron cores 408 fixed to the supporting plate 113 are arranged around the movable iron cores 407. The annular permanent magnets 410 and coils 409 are arranged inside the fixed iron cores 408. A spring 411 for breaking is disposed between the fixed iron cores 408 and the lower face of the supporting plate 113.

The second interlock mechanism is disposed between the third operating mechanism 400 of the earth switch 9 and the second operating mechanism 300 for switching the movable contacts 84, 94 of the switch 8 to the open position Y2 and the disconnection position Y3.

The second interlock mechanism makes it possible to close the movable contact 74 of the earth switch 9 by the electromagnet 405 when the movable contacts 84, 94 are in the disconnection position Y3 of the switch to protect an inspector against, a surge voltage such as thunder, or makes it impossible to close the movable contact 74 of the earth switch 9 when the movable contacts 84, 94 of the switch are in the close position Y1 for supplying current and in the breaking position for breaking current, or makes it impossible to operate the electromagnet 205 of the second operating mechanism 300 when the movable contact 74 of the earth switch 9 is in the close position.

More concretely, the second interlock mechanism is constituted by the pin 412 disposed at the lower end of the driving shaft 406 of the electromagnet 405 of the third operating mechanism 400, the shaft 413 disposed in parallel with the second shaft 401 at the lower end of the electromagnet 305 of the second operating mechanism 300, a lever (not shown) connected to the lower end of the driving shaft 306 of the electromagnet 305 of the second operating mechanism 300, and the lever 414 coupled to the pin 412, which is the shaft 413.

Next, the switchgear of this embodiment will be explained by reference to FIGS. 1 and 6.

When the movable contacts 84, 94 of the switch 8 are stopped at the open position Y2 for breaking current, the lever 203 of the first operating mechanism 200 is given a rotating force in a clockwise direction around the first shaft 201 as an axis in FIG. 1 by a returning farce of the trip spring 212 of the first operating mechanism 200.

Therefore, the pin 302 disposed at the tip of the lever 301 constituting the second operating mechanism 300 touches the outer periphery of the roller 303 so that a further rotation of the lever 301 in the clockwise direction by the returning force of the trip spring 212 is suppressed. That is, the movement of the movable contacts from the open position Y2 for breaking current to the disconnection position Y3 for securing safety of the inspector is prohibited.

Next, the closing operation from the open position Y2 to the close position Y1 by means of the first operating mechanism 200 will be explained. If current is supplied to the coil 209 of the electromagnet 205 of the first operating mechanism 200, the driving shaft 206 moves upward in FIG. 6. The driving shaft 206 moves in the upward direction and the lever 202 swings around the first shaft 201 as a rotating axis in a counter-clockwise direction in FIG. 1 to move the movable contacts 84, 94 towards the close position Y1. In the sate of the close position, the trip spring 212 and the contact spring are biased to prepare the opening movement.

By this closing operation, the pin 302 separates from the outer periphery of the roller 303. The roller 303 does not change its position by virtue of the return spring 311 of the second operating mechanism and is retained in its original position.

As having been discussed, when the switch 8 in the closed position, the second operating mechanism 300 constitutes the mechanical interlock so as to make the disconnection operation by the first operating mechanism 200 from the view point of safety security. That is, when the movable contacts are in the closed position, a mechanical interlock for the breaking and disconnection is realized by that the disconnection operation becomes impossible.

Next, the opening operation from the close position Y1 to the open position Y2 by means of the first operating mechanism 200 will be explained. If the coil 209 of the electromagnet 205 in the first operating mechanism 200 is excited in the reverse direction with respect to that of the closing operation so as to cancel magnetic flux of the permanent magnet 210, the driving shaft 206 moves downward in FIG. 1 by virtue of the accumulated force of the trip spring 212 and contact spring. By this movement of the driving shaft 206 in the downward direction, the lever 301 swings in the clockwise direction in FIG. 1 via the lever 203 and the first shaft 201, wherein the swing movement of the lever 301 in the clockwise direction is suppressed by the pin 302 that contacts the outer periphery of the roller 303. As a result, the movable contacts 84, 94 of the switch 8 are maintained at the open position.

Next, the disconnection operation from the open position Y2 to the disconnection position Y3 will be explained. In the state of the open position of the switch 8 if the upper coil 309 of the electromagnet 305 of the second operating mechanism 300 is excited, the driving shaft 306 moves upward against the force of the return spring 311. The upward movement of the driving shaft 306 lets the roller 303 swing in the counter-clockwise direction in FIG. 1 via the crank lever 304. By this counter clockwise swing of the roller 303, the contacting point of the pin 302 and the roller 303 moves downward. As a result, the operating rod 111 moves upward by means of the lever 301, first shaft 201 and lever 202 thereby to move the movable contact 82 of the switch 8 to the disconnection position Y3.

In the sate of the disconnection the movable iron core 207 of the electromagnet 205 in the first operating mechanism 200 is located below the permanent magnet 210. Accordingly, even if the coil 209 of the electromagnet 205 in the first operating mechanism 200 is excited, attractive force hardly generates because there is little of magnetic flux that passes through the movable iron core 207. That is, a mechanical interlock between the circuit breaker and the disconnector is realized for making closing operation impossible when the movable contact is located in the disconnection position.

Next, operation by the second operating mechanism 300 from the disconnection position Y3 to the open position Y2 will be explained. In the disconnection state when the lower coil 310 of the electromagnet 305 in the second operating mechanism 300 is excited, the droving shaft 306 moves upward and the crank lever 304 swings in the clockwise direction to cause the roller 303 to push up the pin 302, which contacts the roller 303, and the movable contact 84 moves to the position Y2.

Next, when the movable contact 82 of the switch 8 is in the open position Y2 for breaking current, the lever 414 in the second interlock mechanism is coupled with the pin 412 disposed to the lower end of the driving shaft 406 of the electromagnet 405 in the third operating mechanism 400. Therefore, the closing operation of the earth switch 9 by the electromagnet 405 is impossible.

When the movable contact 74 contacts with the fixed contact 73 of the earth switch 9, the lever 414 of the second interlock mechanism touches the pin 412 disposed at the lower end of the driving shaft 406 of the electromagnet 405. Therefore, the operation of the second operation mechanism 300 is impossible to make. Further, when the movable contact 82 of the switch 8 is in the disconnection position 13 for securing safety of the inspector against the surge voltage such as thunder, the lever 414 in the second interlock mechanism makes possible the movement of the pin 412 disposed at the lower end of the driving shaft 406 of the electromagnet 405. Therefore, it is possible to make the closing of the earth switch 9 by the third operating mechanism 400.

Although in the above embodiment the rotatable roller 303 is used as the second operating mechanism, the roller 303 can be replaced with a partially arc cam. Further, the first operating mechanism 200 and the third operating mechanism 400 can be exchanged for their positions. In addition, the electromagnetic system employed for the first operating mechanism 200 can be exchanged with other systems such as electromotive springs.

The essential feature of the present invention, which comprises an insulation system around the connecting conductor 100 that connects the movable conductors 81 and 91 of the two vacuum valves 80, 90 will be explained by reference to FIGS. 1 and 6. The insulating rod 105 connected to the connecting conductor 100 penetrates through an insulating bushing 500 made of epoxy resin or unsaturated polyester resin. The insulating lid 15' having the insulating bushing 500 is gas-tightly fixed to a top end of an insulating envelope 15 by means of a seal 501 such as an insulating rubber made of silicone rubber or ethylene propylene rubber. As a result, the lid 15' and the envelope 15 constitute a molding resin-rubber-molding resin insulation system. The space between the lid 15' and the vacuum valves is gas-tightly sealed so that the components in the space are protected from dirt to thereby improve reliability of insulation. Therefore, it is possible to shorten the length of the insulating rod 105, resulting in downsizing of the vacuum switchgear. Since the interface insulation using the rubber is superior in insulation withstanding to air insulation, the insulation distance of the insulating rod can be shortened to downsize the switchgear.

The outer surface of the lid 15' including the outer surface of the bushing 500 is coated with an electro-conductive coating to be earthed to secure safety of the inspector. Further, the inner face of the lid 15' except the contact faces with the rubber and the through-holes for the insulating rod 105, is coated with the electro-conductive coating Y to be fixed at the same electrical potential as a high voltage part via a wiring pattern 504. By this electro-conductive coating, the vacuum valves 80, 90 are electrically shielded whereby partial discharge or insulation breakdown are prevented.

Since the lid 15', the bushing 500 and the insulating rod 105 are slidable via two rubber rings such as O-rings 502, 503 in the embodiments of FIGS. 1, 5, 7, 8 and 10 so that the sliding faces are gas-tightly sealed to prevent dust from entering, etc. into the sliding faces. Therefore, reliability of the insulation is improved.

Since the insulating bushing 500 and the insulating rod 105 slide each other, the straight movement of the insulating rod 105 and the movable conductors 81, 91 is realized, and as a result, an operating guide for the movable conductors of the vacuum valves 80, 90 may be omitted.

The insulating bushing 500 is sandwiched between the plate 510 and the insulating rubber 501, which are movable up and down directions via a disc spring 511. As a result, it is possible to counter-measure thermal expansion of the insulating rubber 501 due to heat generation at the time of current flow. Instead of the disc spring 511, a coil spring or plate 510 with flexibility can be used.

According to the embodiment described above, since the interface insulation with excellent insulation withstanding is formed by the resin-rubber-resin comprising the insulating bushing 500, the insulating rubber 501 and the insulating envelope 15, it is possible to provide a vacuum switchgear with a reduced dimension in a width and depth. In addition, since the insulating bushing 500 and the insulating rod 105 are subjected to sliding via the rubber rings, the gas-tightness of the inside of the insulating bushing 500 is secured so that contamination of the inside is prevented. From the view point of preventing influence by environment on the contamination, the rubber ring 503 disposed at the upper part is sufficient. By this structure, the insulation distance of the insulating rod 105 can be elongated, and a height of the switchgear can be reduced.

If an insulating medium with high insulating withstanding such as $SF_6$ gas or silicone insulating oil is filled in the gap of the insulating bushing, it is possible to further reduce the height of the switchgear. Further, the insulating bushing plays a role of a guide by which the insulating rod can move straight. That is, it is possible to realize downsizing and improvement of reliability of the vacuum switchgear by the interface insulation, suppression of environmental influence and an operation guide of the insulating bushing.

In the following the second embodiment of the present invention will be explained. The reference 600 in FIG. 5 denotes a terminal for evaluation of soundness of vacuum pressure of the vacuum chambers. The terminal is molded to be disposed in the outer surface of the insulating lid in such a manner that the terminal is opposed to the electro-conductive coating 15 The terminal 600 and the electro-conductive coating coated in the outer face of the lid are electrically insulated from each other.

The soundness of the vacuum pressure of the vacuum valve is normally monitored by applying a voltage between the electrodes. If there is no breakdown of insulation, the vacuum is sound. If not, the vacuum is not sound. In the vacuum valve of this embodiment if one of the vacuum valves 80, 90 is not sound, insulation is maintained by the vacuum of the other vacuum valve. Therefore, it is not possible to evaluate the soundness of vacuum by the above-mentioned method. The terminal 600 is disposed to solve the problem.

If the vacuum valve 80 is not sound, insulation breakdown will take place in the vacuum valve 80 when a voltage is applied to the vacuum valve from the bus-bar side, and a voltage of the conductor 100 will increase. At this time, since a voltage of the electro-conductive coating in the inner surface of the lid increases, the state of vacuum of the vacuum valve can be detected when a voltage induced at the terminal 600 is measured. If a voltage is applied to the terminal from the bus-bar side, the soundness of vacuum of the vacuum valve 80 is detected, and if a voltage is applied to the terminal from the cable side, the vacuum soundness of the vacuum valve 90 is detected.

In the case where the vacuum switch is used as a feeder panel, the terminal 600 can be used as a voltage detector (VD). When power is supplied from the bus-bar 5 side, and when the power is supplied to the load after the switch 8 is closed, a voltage of the conductor 100 increases, induction voltage generates at the terminal 600 so that when the terminal is connected to a voltage indicator, it is possible to recognize the voltage from the outside of the switchgear. Further, in case when the switch 8 is opened and the voltage is indicated, the vacuum of the vacuum valve 80 connected to the bus-bar 5 is judged as "not sound", which can be used as the soundness evaluation of the vacuum valve.

Figure 7:
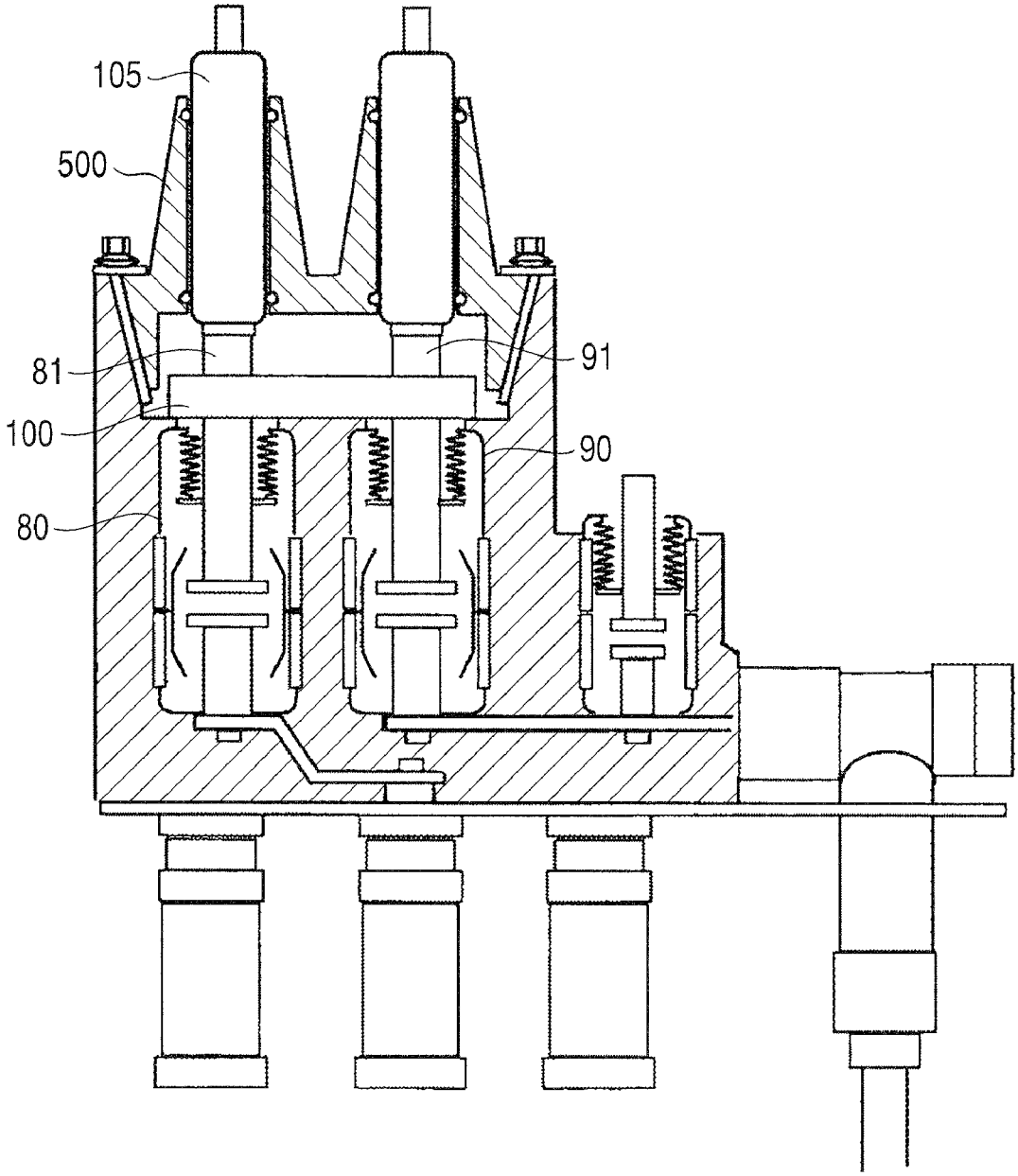
FIG. 7 shows a cross sectional view of a vacuum valve of a second embodiment.

FIG. 7 shows a third embodiment, wherein the movable conductors 81, 91 of the two molded vacuum valves 80, 90 are independently operated. One of the vacuum valves is used as a disconnector and the other is used as a circuit breaker. The movable conductors 81, 91 penetrate the connecting conductor 100 with a commutator (not shown) and are electrically connected to each other, and separately connected to the insulating rods 105. The structure of this embodiment is the same as in the first embodiment, except that the insulating rods 105 penetrate the insulating bushing 500.

Figure 8:
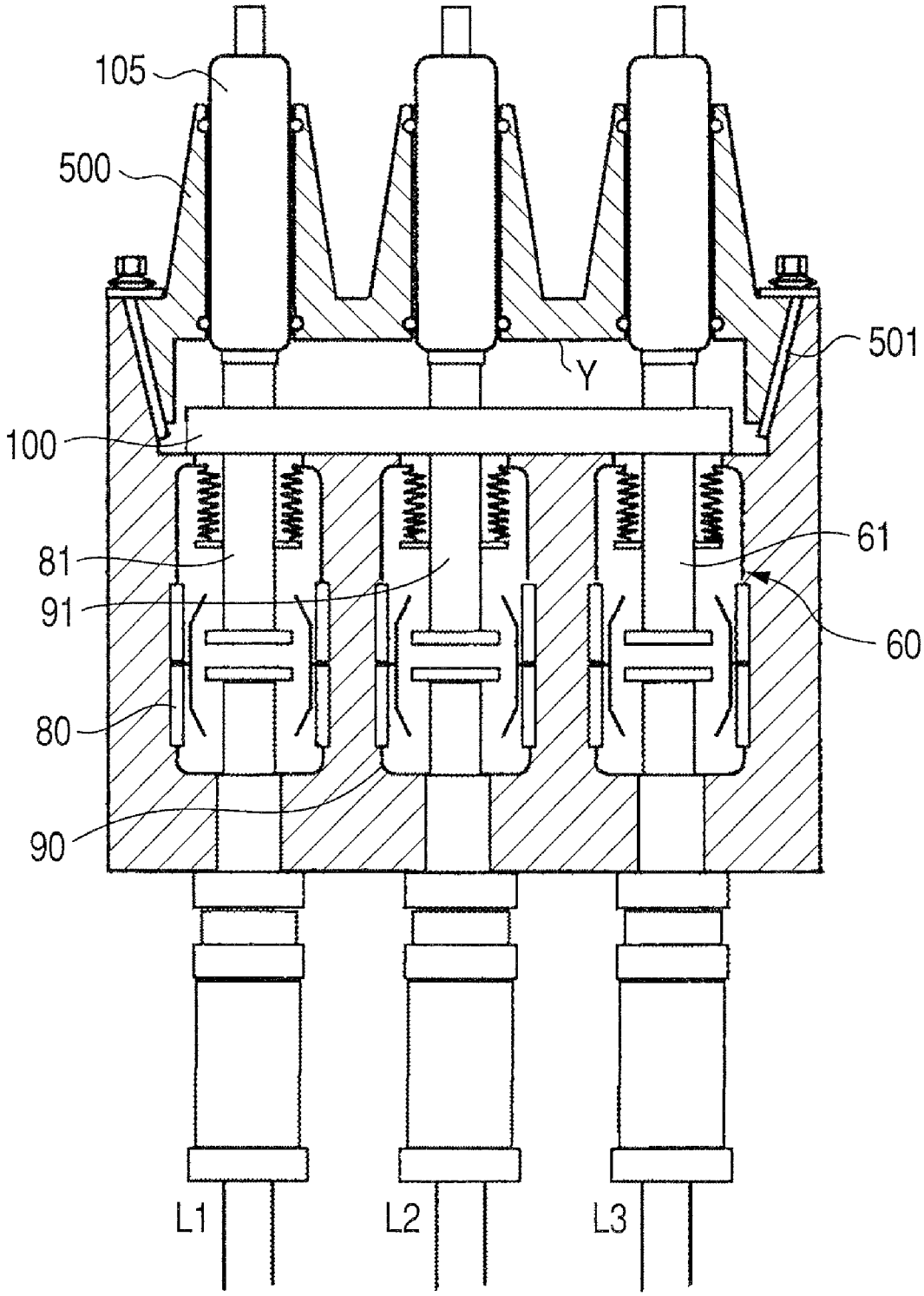
FIG. 8 shows a cross sectional view of a vacuum valve of a third embodiment.

FIG. 8 shows a fourth embodiment. FIG. 8 shows a vacuum switchgear for a ring main unit, which is applied to a loop power receiving system. There are three lines Line 1, Line 2, Line 3 and vacuum valves 80, 90, 60 are integrally molded with resin. The movable conductors 81, 91, 61 are operated independently from each other, and are electrically connected through the connecting conductor 100 with the commutator. The movable conductors are independently connected to the insulating rods 105. Two insulating rods 105 penetrate the insulating bushing 500.

Figure 9:
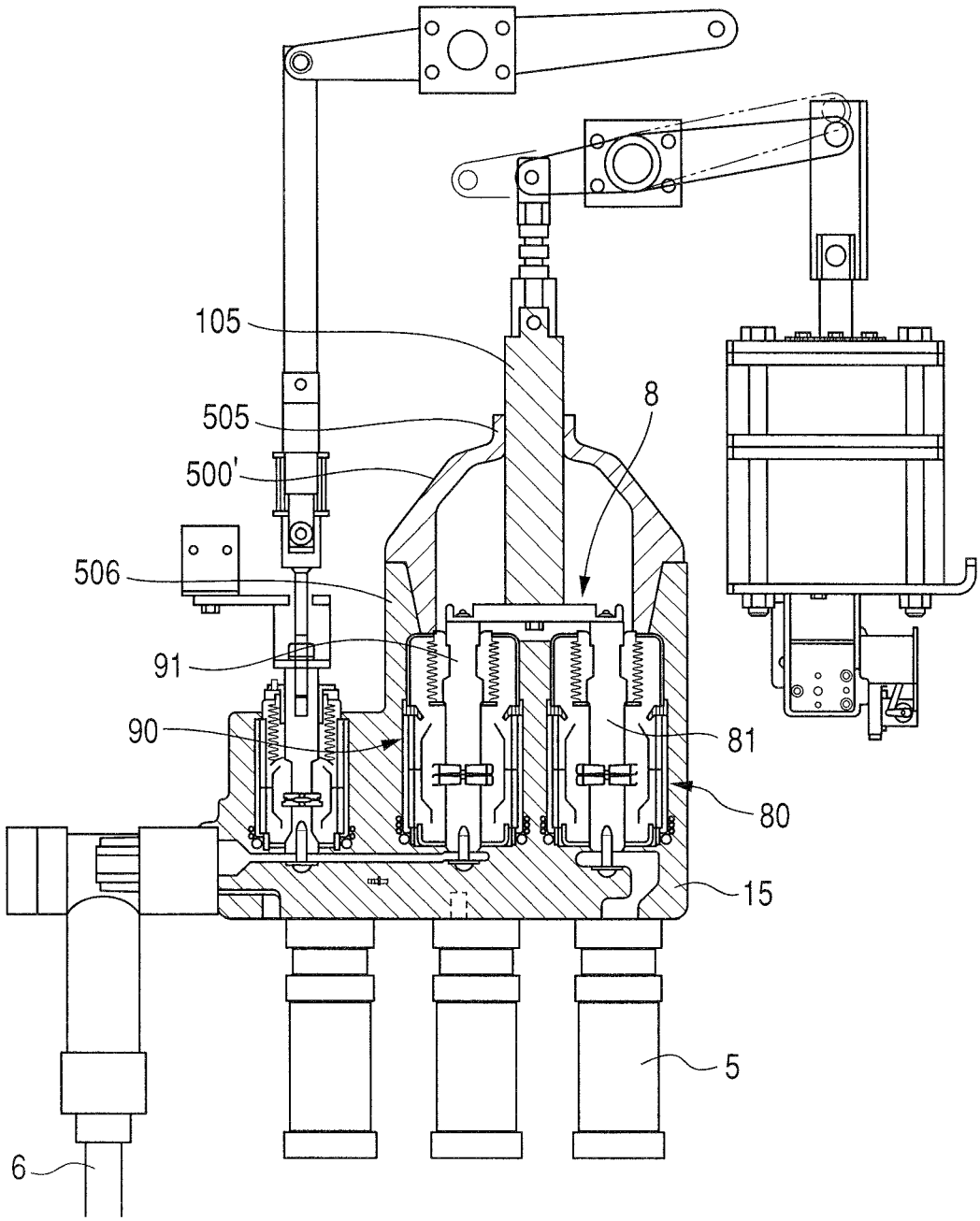
FIG. 9 shows a cross sectional view of a vacuum valve of a third embodiment.

FIG. 9 shows a fifth embodiment of the present invention. FIG. 9 shows an insulating bushing 500 made of a flexible insulating rubber body. The rubber made insulating bushing 500 is fitted at portion 505 to the insulating rod 105 to thereby keep gas-tightness of the air-insulated space of the bushing.

The movable conductors 81, 91 are moved with deformation of the bushing 500. In this embodiment the bushing 500 and the envelope 15 are gas-tightly contacted at portion 506 to constitute interface insulation. Since the flexible rubber insulating body works as an insulating body, which is essential for the interface insulation, the number of components is smaller than that of other embodiments.

Figure 10:
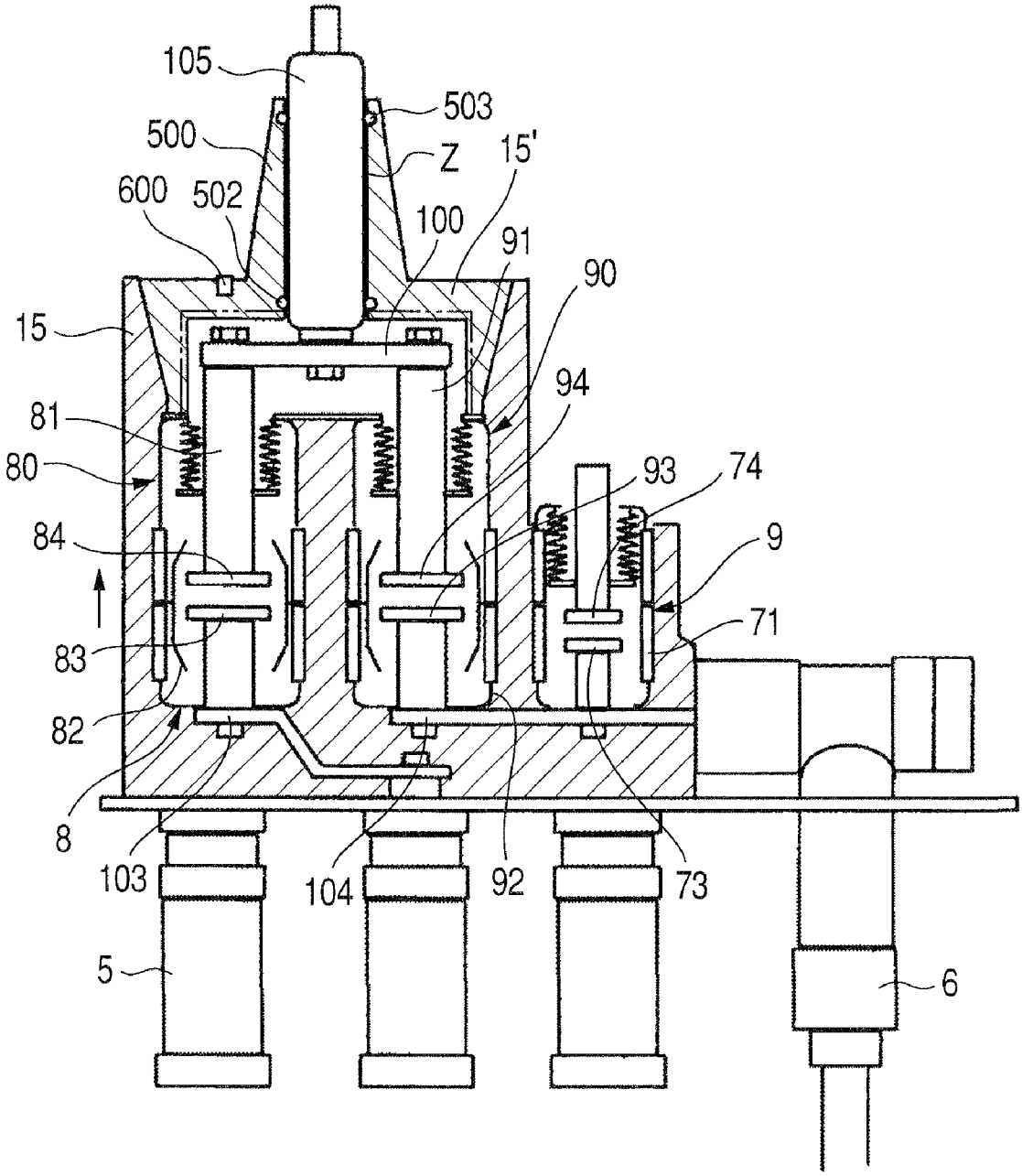
FIG. 10 shows a cross sectional view of a vacuum valve of a fourth embodiment.

FIG. 10 shows a sixth embodiment, which shows a structure comprising two vacuum valves 80, 90, wherein the insulating bushing 500 and the insulating envelope 15 are integrated. That is, before the insulating envelope 15 is molded to accommodate the two vacuum valves 80, 90, the movable conductors 81, 91 are connected with the connecting conductor 100. Then, the insulating rod 105 is connected to the connecting conductor 105. The insulating bushing 500 with lid 15' is fixed to a mold for molding the envelope. Then, the envelope is molded to connect the envelope and the lid.

Since in this embodiment the insulating bushing 500 and the envelope 15 are united, the insulating rubber body used in other embodiments is not necessary. That is, the interface insulation is constituted by resin-resin. In order to secure strength of the envelope and the insulating bushing, it is preferable to use the same resin material.

What is claimed is:

1. A vacuum switchgear comprising:

a vacuum valve comprising a movable conductor having a movable contact, connected to an insulating rod, and a fixed conductor having a fixed contact, connected to a bus bar or to a load cable, wherein the contacts make an electrical contact and a separation therebetween;

a vacuum chamber encasing the vacuum valve;

an insulating envelope covering the vacuum chamber, the outer surface thereof being covered with an electroconductive layer thereby to earth the envelope; and an insulating lid gas-tightly fitted to the insulating envelope, the lid having an insulating bushing through which an insulating rod, connected to the movable conductor of the vacuum valve, penetrates, the insulating rod being connected to an operating mechanism, wherein the insulating rod is slidably inserted into insulating bushing surrounding the insulating rod, and the insulating rod except a portion exposed from the bushing is gas-tightly confined in an insulating gas atmosphere formed between the insulating envelope and the insulating lid.

2. The vacuum switchgear according to claim 1, wherein the vacuum valve is a vacuum double break three position stop type, which comprises at least two vacuum valves each being confined in a vacuum chamber, movable conductors of the vacuum valves being connected to the insulating rod via a connecting conductor.

3. The vacuum switchgear according to claim 1, wherein the insulating envelope contains the vacuum valve and an earth switch, wherein the earth switch is disposed in the insulating envelope and comprises a vacuum chamber for accommodating a movable conductor having a movable contact and a fixed conductor having a fixed contact, the movable conductor being connected to the operating mechanism.

4. The vacuum switchgear according to claim 1, wherein the insulating gas atmosphere between the insulating envelope and the lid is sealed from the atmosphere.

5. The vacuum switchgear according to claim 1, wherein the insulating envelope and the lid are gas-tightly sealed with an insulating rubber.

6. The vacuum switchgear according to claim 1, wherein the inner surface of the lid is covered with an electrically conductive inner coating to make a potential of the inner coating equal to that of the movable conductor.

7. The vacuum switchgear according to claim 1, wherein at least part of the lid is made of a flexible material that allows the movement of the movable conductor, keeping gas-tight sealing of the insulating gas atmosphere.

8. The vacuum switchgear according to claim 1, wherein the vacuum valve is integrally molded with an insulating resin to form the insulating envelope.

9. The vacuum switchgear according to claim 2, wherein the insulating envelope has an insulating wall between the vacuum valves.

10. The vacuum switchgear according to claim 1, wherein the insulating rod, connected to the operating mechanism, is connected to the movable conductor of the vacuum switch by a conductor.

11. A vacuum switchgear comprising:

a vacuum valve comprising at least two movable conductors each having a movable contact, connected to an insulating rod, and at least two fixed conductors each having a fixed contact, connected to a bus bar or to a load cable, wherein the contacts make an electrical contact and a separation therebetween;

vacuum chambers each encasing one of the vacuum valves, the vacuum valves being isolated;

an insulating envelope covering the vacuum chambers, the outer surface thereof being covered with an electroconductive layer thereby to earth the envelope; and an insulating lid gas-tightly fitted to the insulating envelope, the lid having an insulating bushing through which the insulating rods, connected to the movable conductors of the vacuum valves, penetrate, each of the insulating rods being connected to an operating mechanism, wherein each of the insulating rods is slidably inserted into the insulating bushing surrounding each of the insulating rods, and the insulating rods except portions exposed from the bushing are gas-tightly confined in an insulating gas atmosphere formed between the insulating envelope and the insulating lid.

12. The vacuum switchgear according to claim 11, wherein the insulating envelope and the insulating lid are gas-tightly sealed with an insulating rubber fitted therebetween.

13. The vacuum switchgear according to claim 11, wherein an earth switch comprising a vacuum chamber for accommodating a movable conductor having a movable contact and a fixed conductor having a fixed contact is molded together with the vacuum valves, the movable conductor being connected to the operating mechanism.

14. The vacuum switchgear according to claim 11, wherein the vacuum valves are integrally molded with an insulating resin to form the envelope.

15. The vacuum switchgear according to claim 11, wherein the insulating envelope has an insulating wall between the vacuum valves.

16. The vacuum switchgear according to claim 11, wherein the insulating rods, connected to the operating mechanism, are connected to the movable conductor of the vacuum switch by a conductor.

* * * * *